US005988159A

United States Patent [19]

Blount

[11] Patent Number: 5,988,159

[45] Date of Patent: Nov. 23, 1999

[54] GAS-FIRED ARTIFICIAL LOGS AND COALS-BURNER ASSEMBLY

[76] Inventor: Golden Blount, 5310 Harbor Town, Dallas, Tex. 75287

[21] Appl. No.: 08/626,498

[22] Filed: Apr. 2, 1996

Related U.S. Application Data

[63] Continuation-in-part of application No. 08/276,894, Jul. 19, 1994, abandoned, which is a continuation-in-part of application No. 08/061,727, May 17, 1993, abandoned.

[51] Int. Cl.[6] ..... F23C 1/18

[52] U.S. Cl. ..... 126/512; 126/500; 126/540; 431/125

[58] Field of Search ..... 431/125; 126/512, 126/500, 524, 540, 503

[56] References Cited

U.S. PATENT DOCUMENTS

| | | | |
|---|---|---|---|
| 3,042,109 | 7/1962 | Peterson | 126/512 |
| 3,871,355 | 3/1975 | Henry | 431/125 X |
| 5,000,162 | 3/1991 | Shimek et al. | 126/512 |
| 5,033,455 | 7/1991 | Eiklor et al. | 126/512 |
| 5,052,370 | 10/1991 | Karabin | 126/512 |
| 5,081,981 | 1/1992 | Beal | 126/92 R |
| 5,263,852 | 11/1993 | Beck | 431/125 |

*Primary Examiner*—Larry Jones
*Attorney, Agent, or Firm*—L. Dan Tucker

[57] ABSTRACT

A gas-fired artificial logs and coals-burner assembly is provided for fireplace use in cooperation with decorative gas logs, and artificial coals and embers decorative items by placement forward of the gas logs in the fireplace arrangement, a secondary elongated coals- and embers-burner tube apparatus. The assembly provides gas-fired artificial logs, coals- and embers-burner apparatus for fireplaces wherein gas flow through primary burner tube is the source of gas flow to a secondary coals- and embers-burner tube positioned forward and below the primary burner tube with multiple discharge ports in the secondary tube directed away from the front of the fireplace, thus enhancing the natural burn in cooperation of the fireplace draft as well as the aesthetic beauty of the imitation burning logs, coals and embers.

19 Claims, 3 Drawing Sheets

GAS-FIRED ARTIFICIAL LOGS AND COALS-BURNER ASSEMBLY

The present application is a continuation-in-part application of U.S. patent application Ser. No. 08/276,894, filed Jul. 19, 1994, now abandoned, entitled "A Supplemental Burner for Retrofitting to an Existing Gas Log Burner Assembly" which is a continuation-in-part application of U.S. patent application Ser. No. 08/061,727, filed May 17, 1993, entitled "Controlled Ember Bed Burner" which is now abandoned.

TECHNICAL FIELD OF THE INVENTION

The present invention relates to a gas-fired artificial logs and coals-burner assembly for a fireplace to be used with decorative gas logs and coals or embers decorative items placed forward of the gas logs in the fireplace arrangement. In another aspect, the invention relates to coals- and embers-burner apparatus suitable for attaching to a terminal end of a gas-fired primary artificial burner, the coals- and embers-burner assembly utilizing a valve between the primary artificial logs burner and the coals- and embers-burner.

In yet another aspect, the invention relates to a gas-fired artificial logs, coals- and embers-burner assembly for fireplace wherein gas flow through a primary burner tube is the source for gas flow to a secondary coals burner tube positioned forward and below the primary burner tube with the multiple discharge ports in the secondary tube directed away from the front of the fireplace.

The present further relates to efficient gas burners for burning natural gas, manufactured gas and propane gaseous fuels within a fireplace environment. In addition, the invention provides an efficient burner system for burning gaseous fuels in a manner which provides decorative flames and decorative coals and embers which simulate wood burning.

Gas logs are usually made of a fire resistant ceramic material; however, when gas flames are directed against such ceramic materials, the gas flame is cooled by the artificial logs and many times produces a highly inefficient and dirty yellow flame. Such a flame further indicates incomplete burn of the gaseous materials due to a lack of sufficient burn temperature and oxygen supply thus creating excessive soot and carbon monoxide. Various attempts have been made in correcting these decorative fireplace gas log deficiencies.

Further it is known that gas burners or gas nozzles can be buried below a level of sand and vermiculite. These burner systems are referred to as sand pan burners which disburse the gasses through the fireproof material and permit the gas permeating through the porous material to ignite upon entering the atmosphere. Such systems allow disbursal of the flames over a large area or bed of material. Such disbursal of flames creates a more efficient burn which further simulates the action of burning wood, ashes and embers in a fireplace.

Prior art burner systems for artificial decorative logs and sand pan type burners are incorporated in various prefabricated fireplaces or existing masonry fireplaces; however, such systems are required to meet the ANSI emission standards which have been adapted by the American Gas Institute. Accordingly, it is very desirable to provide a clean burning gas-fired artificial logs and coals-burner assembly which meet the present ANSI emission standards.

Gas logs are increasingly popular in homes. Decorative artificial logs are placed on a grate which is located over a gas burner. The burner is typically a tube with spaced apertures. Sand is poured over the gas burner to hide it from sight. Artificial embers are then spread across the sand. In use, gas flows through the burner and escapes through the spaced apertures. The gas filters up through the sand underneath the artificial logs. The gas is ignited and creates flames between the logs. The height of the flame is controlled by a primary valve which can be manipulated by the user.

Gas logs can, under these conditions, provide a great deal of heat to a room. Also, gas logs require virtually no effort to light. Natural logs, on the other hand, must be properly cured before burning. Even then, kindling is usually needed. And once lit, it is difficult to control the rate of burning. Beyond convenience, gas logs are also aesthetically pleasing. However, the standard gas logs burner only creates flames around the artificial logs. Natural logs, when burned will break apart to produce beautiful burning embers in front of the main log stack. A need exists to produce a more realistic aesthetic burn with gas logs.

Due to the popularity of gas logs, a number of advances have been patented. For example, U.S. Pat. No. 5,000,162 to Shimek et al. discloses a "Clean Burning Glowing Ember and Gas Log Burner System." This unit is marketed under the trademark Heat-N-Glow as the Model 5000GDVMH as a self-contained fireplace and wall heater for mobile homes. The system is a low-BTU system whose main objective is to minimize carbon monoxide creation and soot deposit on the logs. A burner system is provided with a first branch and a second branch. The first branch is supported on a prefabricated grate between a first and second decorative log. The second branch is forward of the logs and is protected under a metal mesh. A very light layer of special ember material is spread on top of the mesh. Shimek et al. '162 is only sold as a complete system of logs, burner and special ember material. It cannot be fitted to existing pan burners which are by far the most common burner in use, the combination resulting in the assembly of the invention. Thus, the Shimek burner system is an expensive option.

The Shimek burner system provides a metal trim piece or refractory material in front of the second burner pipe branch so that it is not easily viewed by a person standing in front of the fireplace. The second branch only illuminates a thin line of ember material. Neither the first or second branch can be covered by sand as is common in other units. The gas apertures in the branches are located on the upper surface of both branches. Thus, sand could easily clog the apertures. Moreover, the flow of gas into the second branch cannot be regulated.

U.S. Pat. No. 5,052,370 to Karabin discloses a "Gas Burner Assembly Including Emberizing Material." The gas burner comprises a first and second gas-burner assembly. The first gas-burner assembly is formed by a pair of parallel burner tubes connected by a third burner tube. The second gas-burner assembly is located forward of the first assembly and is generally T-shaped. The second burner only illuminates a thin line of ember material. A single gas source supplies both burner assemblies. An igniter is provided to ignite the gas from the main burner assembly. The flame from that burning gas ignites the gas from the second burner assembly. As with the Shimek et al. burner assembly, the flow of gas to the second burner assembly cannot be controlled.

Finally, U.S. Pat. No. 5,081,981 to Beal discloses yet another burner and is entitled "Yellow Flame Gas Fireplace Burner Assembly." The Beal reference is primarily concerned with producing a clean yellow flame. The burner assembly includes a U-shaped burner tube. The front portion of the burner tube is forward of the artificial logs and provides flame for ember material. However, as with the Shimek reference above, the forward portion of the burner tube is hidden from view by a portion of the grate. The Beal system does not contemplate the present assembly. Furthermore, as with both the Shimek and Karabin references, there is no means provided to control separately the flow of gas into the front burner tube.

A need exists for an inexpensive assembly for improving the performance and aesthetic appeal of pan-type gas burners. The assembly should distribute gas under artificial coals or embers in front of the gas-fired logs. The assembly should also provide a method of controlling the flow of gas to a secondary burner, thus controlling the height of the coals and embers bed flames and the amount of heat radiated into a room. A need further exists for an assembly which can safely operate even if completely covered by sand and enhances gas burn of both primary log burner and secondary coals and embers burner by gas flow control and burn direction.

These present and long-felt needs for gas logs and glowing coals- and embers-burner systems will burn clean and closely simulate the natural flames produced by burning wood logs have not yet been met by the art. Therefore, it is desirable to produce a reliable and efficient gas logs and glowing coals- and embers-burner assembly which produces the desired efficiency of burn while providing decorative flames that closely simulate burning wood logs while at the same time providing useable heat and still meet EPA regulations and the ANSI emissions and safety standards.

SUMMARY OF THE INVENTION

It is a primary object of the present invention to provide a highly efficient gas-burner assembly for use with artificial, decorative logs and glowing coals and embers wherein the assembly provides control for the glowing coals and embers independently of the gas logs burn.

It is another primary object of the present invention to provide a novel burner assembly which closely simulates the flames, embers and coals of natural wood logs burn.

It is another principle object of the present invention to provide a novel burner assembly which has low carbon monoxide emission characteristics.

It is yet another object of the present invention to provide an efficient low carbon monoxide emission burner assembly that combines long decorative gas flames with short or low smoldering glowing embers and coals in the same assembly.

It is another object of the present invention to provide a gas flow communicating primary and secondary burner tubes with the gas distribution ports of the secondary burner tube directed away from the opening of the fireplace and utilizing the natural draft of the fireplace to enhance the overall efficiency of the burn of the two burners.

The present burner assembly is the combination of an inexpensive primary gas logs burner assembly in gas flow communication with a secondary coals- and embers-burner tube positioned forward and below the primary burner which operates to enhance the natural draft of the fireplace to improve efficiency of burn and aesthetic appeal of the gas-fired artificial logs, coals- and embers-burner assembly. The secondary burner can distribute gas under artificial coals and embers in front of the gas logs with control of the gas flow to the secondary burner being readily adjustable by a valve in the connection means between the primary and secondary burners. The secondary burner receives gas through the primary burner, the connection means, and the gas flow is regulated selectively by the valve which is interposed between the primary and secondary burners in the connection means. The control of gas flow thus controls the height of the coals and embers bed flames and the amount of radiant heat which is produced in the front of the fireplace and is distributed into the room. The amount of radiant heat can be enhanced by utilizing the control valve for increasing the amount of gas being burned in the secondary burner or the utilization of even a tertiary burner along with the secondary burner which are provided forward of the gas logs arrangement in the fireplace. The secondary burner can operate efficiently when completely covered with sand and artificial coals and embers materials, there being no need for a new grate to hide the secondary burner.

The ability to regulate the flow of gas to the secondary burner is an especially important feature. In addition, the gas flow from the secondary burner away from the opening of the fireplace and, in effect, toward the primary burner is also of special importance because of the utilization of the fireplace natural draft and direction of flames to more completely burn the gas, avoid any pockets of gas in front of the gas logs. The direction of the gas dispersion from the secondary burner ensures that through the action of the natural draft of the fireplace and the burning logs from the primary burner that complete and total combustion in an efficient manner will be achieved of the gas flowing from the secondary burner which is positioned somewhat forward of the primary burner.

People buy gas logs primarily for convenience, but this does not means that they want to give up on the beauty of burning real logs. Standard pan burners only provide part of that beauty. Having roaring flames throughout the logs is greatly complemented by lower flames in front of the gas logs throughout a coals and embers bed. None of the prior art references above feature or even suggest a variable control means for accomplishing lower flames in the coals and embers bed. Moreover, every fireplace drafts differently. Such differences in fireplace construction and drafting, i.e., fireplace draft, as well as sizing and manufacture of present artificial fireplace burner apparatus dictates that variable control of the secondary burner, the coals and embers burner which operates independently of the primary logs burner is necessary. Volume and velocity of air entering the firebox varies according to the size of the room, height of the ceilings, and size of the firebox. None of the prior art references compensate for the varying drafts of fireplaces and therefore fail to accommodate all fireplaces while attempting to provide the maximum aesthetic beauty desired and efficiency of burn.

Most importantly, the gas-fired artificial logs, coals- and embers-burner assembly through the secondary burner control afforded by the valve, allows the user to selectively increase the amount of gas being burned forward of the artificial logs. This control also affords a greater introduction of radiant heat to the room as desired on colder days. As previously discussed, artificial gas logs can act as a heat sink and absorb heat produced by the flames. The heat generated by the secondary burner is largely radiant and is projected into the room, which affords quick heating of the room while also providing the aesthetic beauties of a gas-fired artificial logs, coals- and embers-burner assembly operation.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE DRAWINGS

Figure 1:
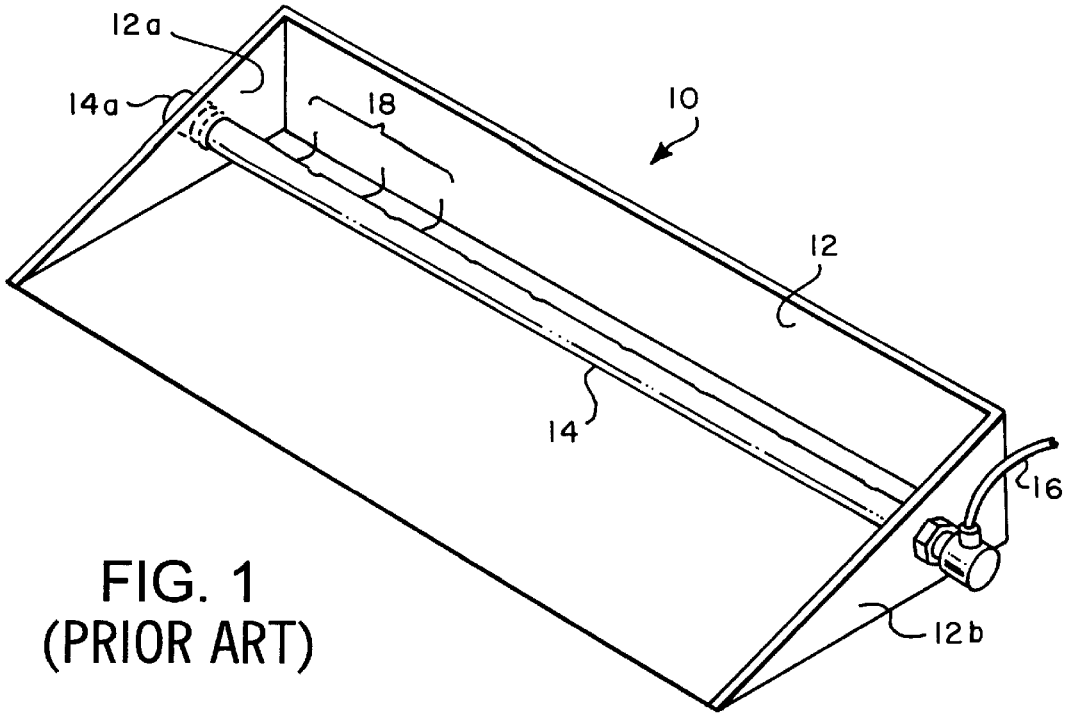
FIG. 1 (PRIOR ART)
FIG. 1 provides a perspective view of a prior art pan burner used with artificial gas logs.

The present assembly provides a number of advantages over the burner assemblies disclosed in the prior art. FIG. 1 illustrates a standard pan burner 10 which is used in the vast majority of artificial log sets. The pan burner 10 has an open frame 12 which supports a burner tube 14. An inlet 16 is connected to a gas source (not shown). A plurality of apertures, as evidenced by gas plumes 18, are spaced along the length of the burner tube 14. Gas escapes through the apertures and filters through sand (not shown). Gas which escapes from the sand is initially ignited to create flames. These flames are continually fed by the escaping gas. The burner tube 14 is supported by the side walls 12*a*, 12*b* of the frame 12. The burner tube 14 extends beyond the side wall 12*a* and is capped.

Figure 2:
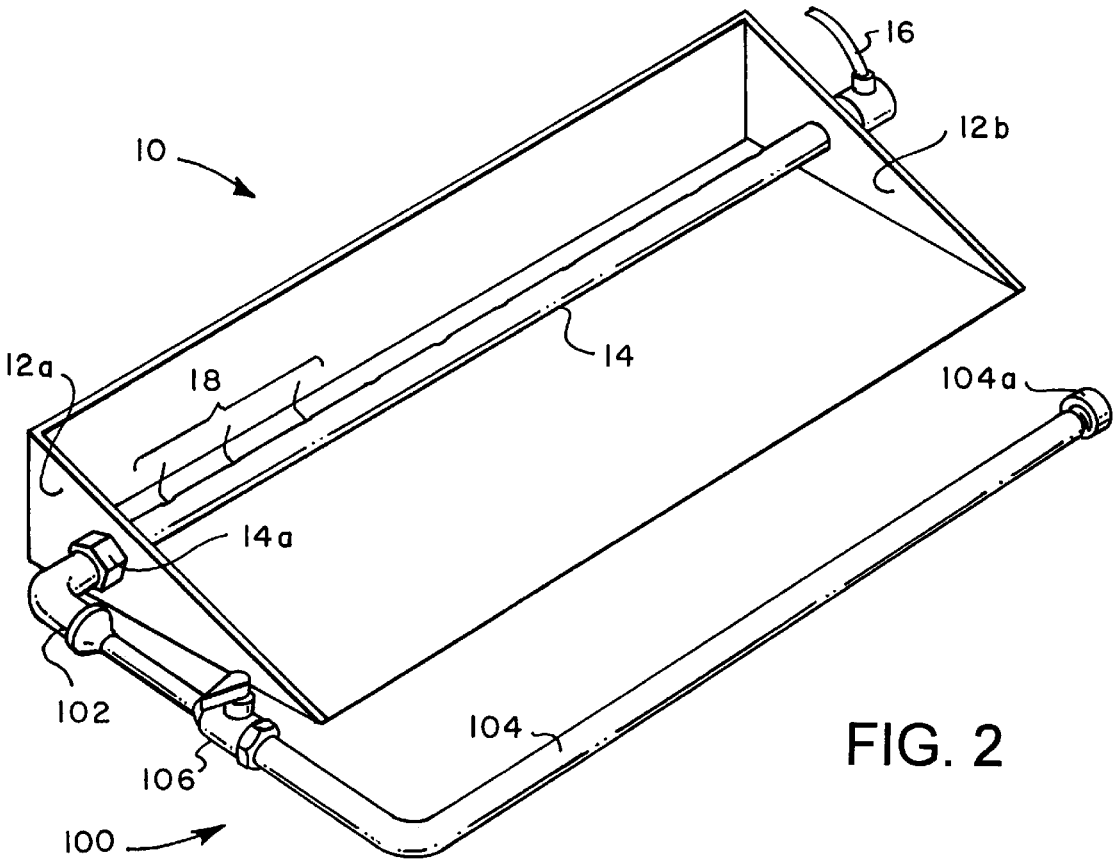
FIG. 2 provides a gas-fired artificial logs primary pan tube burner and secondary coals and embers tube burner.

FIG. 2 illustrates a secondary burner apparatus 100 which embodies the present invention in combination with primary burner tube 14. The secondary burner apparatus 100 can be retrofitted to the terminal end 14*a* of the burner tube 14 in the pan burner 10. The cap must be removed from the terminal end 14*a*. A connector 102 is then attached to the uncapped end of burner tube 14. The connector 102 is fitted to the secondary burner tube 104 creating an enclosed fluid path for the gas. The connections between the connector 102 and the terminal end 14*a* should be adequately sealed to prevent leakage. Likewise, the connection between the connector 102 and the secondary burner tube 104 should also be properly sealed. A valve 106 is interposed in this fluid path. The valve 106 can be variably positioned to give the user the ability select the amount of gas entering the secondary burner. The secondary burner tube 104 is generally parallel to the primary burner tube 14. The terminal portion of the secondary burner tube 104*a* is closed. The primary and secondary burner tubes are typically made of steel.

A plurality of apertures 108 are along the length of the secondary burner tube 104. The apertures 108 can be evenly spaced or clustered. The apertures 108 are typically between 1/32 and 1/8 inch in diameter, but are preferably 1/16 of an inch in diameter. More importantly, the apertures are located along the radial edge of the secondary burner tube 104, below the upper ridge of the tube. By avoiding the upper ridge, the apertures are less likely to be clogged by sand. Gas passing through the valve 106 enters the secondary burner tube 104 and escapes through the spaced apertures. The apertures can be evenly spaced or clustered.

These various spaced apertures or gas discharge ports are most important in their position in regard to both the primary and secondary tube burners. In the secondary burner tube 104, the gas is discharged in a direction away from the opening of the fireplace or in another aspect is directed somewhat toward or directly toward the primary burner tube 14. The effects of such gas burn direction enhances the aesthetic beauty of the overall logs, coals, and embers burn, but, more importantly, provide several safety features of the gas-fired artificial logs, coals- and embers-burner assembly. First, the natural draft of the fireplace provides a more efficient burn of the gas and avoids high or intolerable levels of carbon monoxide. Even more importantly is that the backward direction or gas flow direction toward the primary burner from the secondary burner avoids creation of pockets of gas in the sand and other coverage material of these burners which could possibly create a flash explosion due to accumulated gas. For example, if the gas is directed from the secondary burner 104 toward the opening of the fireplace, then two independent sources of gas pocketing occurs—one on the gas logs primary burner which may or may not be covered by granular materials as well as that generated by the secondary burner which is removed from about four to eight or ten inches in front of the primary burner. Lighting of such gas distribution pockets would be hazardous and uniformity of coordinated burn utilizing natural draft of the fireplace would be lost. If the secondary burner 104 discharges gas in a vertical direction, apertures in the sand or coverage granular material will occur and one would lose the aesthetic beauty of the applications of distribution of gas for burning and creating flame coals' and embers' appearance.

In the gas-fired artificial logs, coals- and embers-burner assembly of the invention, the primary elongated burner tube can be comprised of a one-half inch pipe while the secondary coals- and embers-burner elongated tube can be of a one-quarter inch pipe. These dimensional relationships can be varied depending on the needs for gas volume and the size of the fireplace. The spacing between the primary and secondary burner tubes can also be varied within reasonable lengths of from about four to eight or ten inches depending on the size and depth of the coals and embers bed one requires. The secondary elongated burner tube can also have adjustments for height, meaning distance elevated from the floor of the fireplace, again depending on the depth and size of the coals and embers fire bed. In all of these dimensional relationships, the present invention provides an adjustable burn facility for the secondary elongated burner tube which controls the amount of coals and embers flame and glow, again depending on the individual's desires, size of the room, size of the fireplace and the amount of natural draft through the fireplace.

Figure 3:
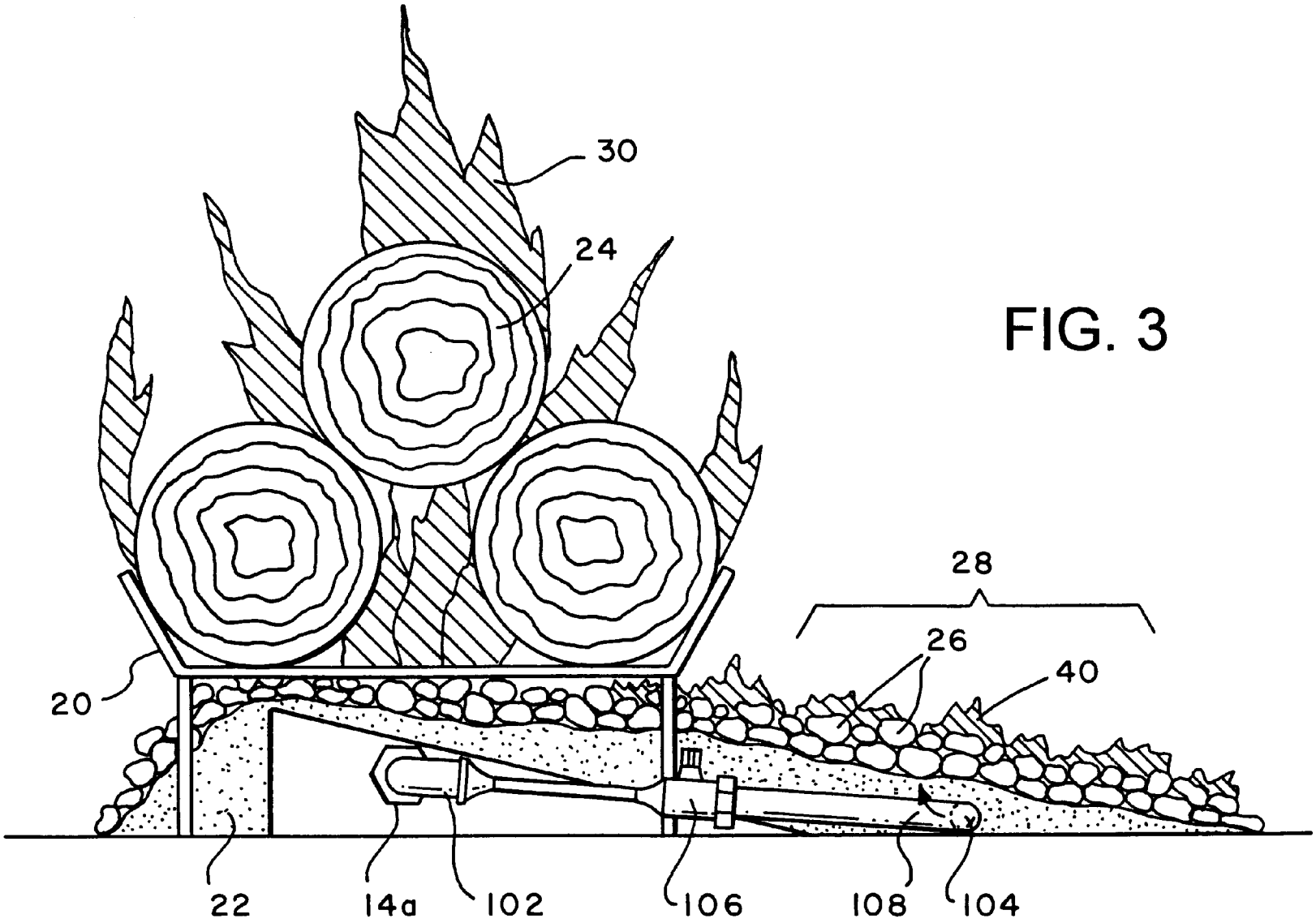
FIG. 3 illustrates the effect of the present assembly in providing logs, coals and embers flames.
Figure 4:
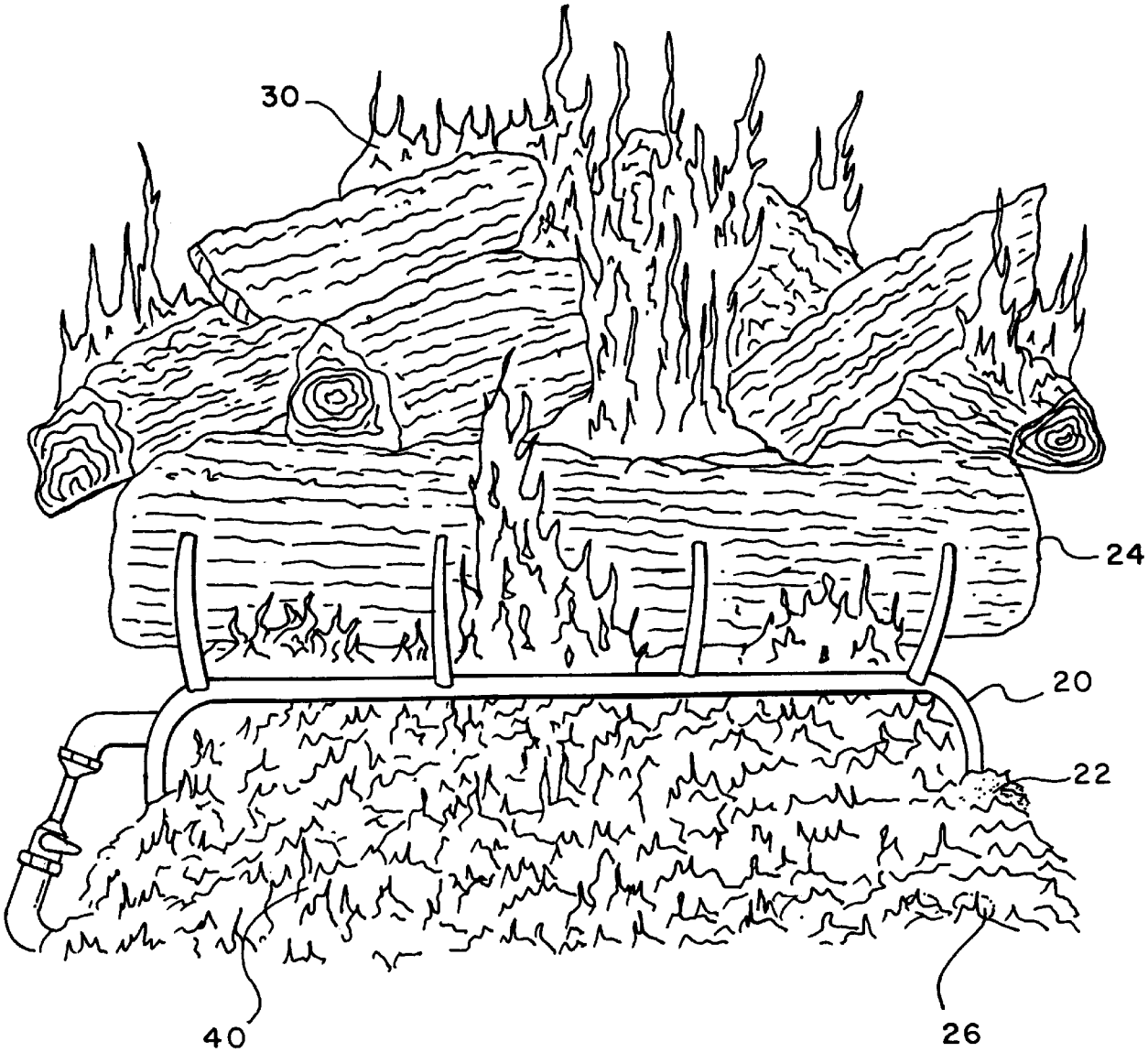
FIG. 4 is a front view of the assembly illuminating the coals and embers bed and gas logs flames.

FIGS. 3 and 4 illustrate the effect of the secondary burner apparatus 100 once connected to the pan burner 10. As discussed, a grate 20 is located above the pan burner which is covered with sand 22. The grate 20 can hold at least one artificial log 24. Artificial ember material 26 which glows when heated can be strewn under and around the artificial logs and on top of the sand. Flames 30 fed by gas from the primary burner tube 14 rise through the artificial logs 24. Flames 40 fed by gas from the secondary burner tube 104 can rise through the artificial ember bed 28. As illustrated, the flames 40 can be lower than the flames 30, thus providing an aesthetically pleasing sight.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

What is claimed is:

1. A gas-fired artificial logs and coals-burner assembly for fireplace comprising:

an elongated primary burner tube including a plurality of gas discharge ports;

a secondary coals burner elongated tube positioned forwardly of the primary burner tube;

a support means for holding the elongated primary burner tube in a raised level relative to the forwardly position secondary coals burner elongated tube;

the secondary coals burner elongated tube including a plurality of gas discharge ports;

the elongated primary burner tube and the secondary coals burner elongated tube communicating through tubular connection means wherein the gas flow to the secondary elongated coals burner tube is fed through the primary burner tube and the tubular connection means;

a valve for adjusting gas flow to the secondary coals burner elongated tube positioned in the tubular gas connection means; and the primary burner tube being in communication with a gas source with a gas flow control means therein for controlling gas flow into said primary burner tube.

2. The gas-fired artificial logs and coals-burner assembly according to claim 1 wherein the support means for the primary burner tube is comprised of an open frame pan for supporting the primary burner tube in an elevated position relative to the fireplace floor.

3. The gas-fired artificial logs and coals-burner assembly according to claim 1 wherein the secondary coals burner elongated tube discharge ports are directed toward the primary burner elongated tube at an angle of from about 5 to about 75 degrees based on the plane of the fireplace floor.

4. The gas-fired artificial logs and coals-burner assembly according to claim 3 wherein the secondary coals burner elongated tube discharge ports directed toward the primary burner tube utilizes the fireplace natural draft in achieving combustion of both gas sources in sufficient air to maintain satisfactory levels of CO.

5. The gas-fired artificial logs and coals-burner assembly according to claim 1 wherein the secondary coals burner elongated tube is substantially parallel to the primary burner tube and has a smaller inside diameter than the primary burner tube with the valve adjusting gas flow for coals burn and forwarding heat radiation from the fireplace.

6. The gas-fired artificial logs and coals-burner assembly according to claim 4 wherein the primary burner tube is comprised of a standard half-inch pipe and the secondary burner tube is comprised of a standard quarter-inch pipe.

7. The gas-fired artificial logs and coals-burner assembly according to claim 1 wherein the elongated primary burner tube and the secondary coals burner elongated tube are spaced apart on different planes at from about four to about eight inches.

8. The gas-fired artificial logs and coals-burner assembly according to claim 1 wherein the secondary coals burner elongated tube is of a smaller diameter than the primary burner tube which allows for a lower profile of coals and sand coverage.

9. The gas-fired artificial logs and coals-burner assembly according to claim 1 wherein the secondary coals burner elongated tube is adjustable in height relative to the floor of the fireplace and the elevated primary burner tube.

10. The gas-fired artificial logs and coals-burner assembly according to claim 1 wherein at least two secondary coal burner elongated tubes are utilized for artificial coal burn and radiant heat generation.

11. The gas-fired artificial logs and coals-burner assembly according to claim 1 wherein the primary and secondary burner tubes have apertures of from about 1/32 inch to about 1/8 inch.

12. The gas-fired artificial logs and coals-burner assembly according to claim 1 wherein the gas flow adjustment valve has a removable handle, the gas flow adjustment allowing a variety of settings from full closed to full open.

13. The gas-fired artificial logs and coals-burner assembly according to claim 1 wherein the connection means is comprised of a connector attached to the terminal end of the primary burner tube at a first end of a connector and attached to the secondary coals burner elongated tube to a connector second end with the valve interposed between the primary burner tube and the secondary burner tube.

14. The gas-fired artificial logs and coals-burner assembly according to claim 13 wherein the connector generally is shaped outward from the first end connected to the primary burner tube, directed generally perpendicular to the burner tubes alignment and inward to the second end connected to the secondary burner tube, the valve and connector being positioned generally exterior of the primary and secondary burner tube fire zones.

15. The gas-fired artificial logs and coals-burner assembly according to claim 1 wherein the open frame pan and primary elongated burner tube is positioned under an artificial logs and grate support means.

16. The gas-fired artificial logs and coals-burner assembly according to claim 1 wherein the primary elongated burner tube is covered with sand and the secondary elongated burner tube is covered with sand, mica, and fibrous materials which simulate coals and ember burn.

17. A gas-fired artificial coals- and embers-burner apparatus suitable for attaching to a gas-fired primary artificial log burner tube said primary artificial log burner tube having a terminal end comprising:

a secondary coals burning elongated tube;

a connector means for connecting said terminal end in communication with the secondary burner tube, the secondary burner tube positioned substantially parallel, forward and below the primary burner tube, the connector means having interposed between the primary and secondary burner tubes a gas flow adjustment valve, the primary and secondary burner tubes having a plurality of gas discharge ports, the secondary burner tube being in gas flow communication with the primary burner tube being the connection means, a gas distribution ports of the secondary burner tube directed away from the fireplace opening.

18. The gas-fired artificial coals- and embers-burner apparatus according to claim 1, wherein the gas distribution ports of the secondary burner tube are directed toward the primary burner tube at from about 5 degrees to about 75 degrees elevation from the fireplace floor.

19. A gas burner assembly for use in a fireplace comprising:

a primary burner tube having a first end and a second end, said first end adapted to be connected to a gas source with a gas flow control means for controlling the amount of gas flowing into said primary burner tube;

a second burner tube;

a connector tube attached to said second end of said primary burner tube and to said second burner tube to provide fluid communication between said primary burner tube and said second burner tube; and a valve disposed in said connector tube for selectively controlling the flow of gas from said primary burner tube into said second burner tube.

* * * * *